US011156073B2

(12) United States Patent
Rabba et al.

(10) Patent No.: US 11,156,073 B2
(45) Date of Patent: Oct. 26, 2021

(54) DRILLING WELLBORES IN A MULTILAYERED RESERVOIR

(71) Applicant: Saudi Arabian Oil Company, Dhahran (SA)

(72) Inventors: Ali Saleh Rabba, Dhahran (SA); Sultan S. Madani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/804,980

(22) Filed: Feb. 28, 2020

(65) Prior Publication Data

US 2021/0270118 A1 Sep. 2, 2021

(51) Int. Cl.
*E21B 43/30* (2006.01)
*E21B 34/06* (2006.01)
*E21B 7/04* (2006.01)

(52) U.S. Cl.
CPC ..... *E21B 43/305* (2013.01); *E21B 7/04* (2013.01); *E21B 34/06* (2013.01)

(58) Field of Classification Search
CPC ..... E21B 43/305; E21B 34/06; E21B 7/04; E21B 7/046
See application file for complete search history.

(56) References Cited

U.S. PATENT DOCUMENTS 8,146,685 B2 4/2012 Lee et al.
2004/0108110 A1 6/2004 Zapanick
2010/0181114 A1* 7/2010 Best ..... E21B 43/17 175/65
2011/0203792 A1 8/2011 Looney et al.
2012/0145463 A1 6/2012 Lee et al.
(Continued)

FOREIGN PATENT DOCUMENTS

WO WO 2010016767 2/2010

OTHER PUBLICATIONS

Beckner and Song, "Field Development Planning Using Simulatd Annealing—Optimal Economic Well Scehdualing and Placement," Paper SPE 30650, Presented at the SPE ATCE, Dallas, Texas, Oct. 22-25, 1995; Society of Petroleum Engineers, 1995, 13 pages.
(Continued)

*Primary Examiner* — George S Gray
(74) *Attorney, Agent, or Firm* — Fish & Richardson P.C.

(57) ABSTRACT

A method includes drilling a first, non-vertical wellbore in a first direction. The first wellbore includes a first heel section residing at a first production zone of a subterranean formation and a first toe section downhole of the first heel section and residing at a second production zone of the subterranean formation. The first wellbore defines a first central axis defining a first plane. The method also includes drilling a second, non-vertical wellbore in a second direction opposite the first direction. The second wellbore defines a second central axis defining a second plane substantially parallel to the first plane. The second wellbore includes a second heel section residing at a third production zone opposite the first production zone and a second toe section downhole of the second heel section and residing at a fourth production zone opposite the second production zone to help prevent pressure interference between the wellbores.

20 Claims, 3 Drawing Sheets

(56) References Cited

U.S. PATENT DOCUMENTS

| | | | | |
|---|---|---|---|---|
| 2015/0192002 | A1* | 7/2015 | Rogers | E21B 43/305 166/272.2 |
| 2018/0017691 | A1* | 1/2018 | Dirksen | E21B 7/04 |
| 2019/0153841 | A1 | 5/2019 | Randall et al. | |

OTHER PUBLICATIONS

Bouzarkouna et al., "Well placement optimization with the convariance matrix adaptation evolution strategy and metamodels," Computational Geosciences, Sep. 2011, 16(1): 75-92.

Carpenter, "Smart-Horizontal-Well Drilling and Completion for Thin-Oil-Rim Reservoirs in Malaysia," JPT, SPE-0515-0103-JPT, May 2015, 4 pages.

PCT International Search Report and Written Opinion in International Appln. No. PCT/US2021/019438, dated May 11, 2021, 14 pages.

* cited by examiner

DRILLING WELLBORES IN A MULTILAYERED RESERVOIR

FIELD OF THE DISCLOSURE

This disclosure relates to wellbores, in particular, to methods of drilling wellbores.

BACKGROUND OF THE DISCLOSURE

Horizontal wellbores can be used to enhance reservoir performance by placing a long wellbore section within one or multiple reservoirs. To increase the rate of production, multiple horizontal wellbores can extract hydrocarbons from the same reservoir. Minimizing the space between reservoirs can help increase the number of wellbores per unit area.

SUMMARY

Implementations of the present disclosure include a method of placing two wellbores. The method includes drilling a first, non-vertical wellbore in a first direction. The first wellbore includes a first heel section residing at a first production zone of a subterranean formation and a first toe section downhole of the first heel section and residing at a second production zone of the subterranean formation. The first wellbore defines a first central axis defining a first plane. The method also includes drilling a second, non-vertical wellbore in a second direction opposite the first direction. The second wellbore defines a second central axis defining a second plane substantially parallel to the first plane. The second wellbore includes a second heel section residing at a third production zone opposite the first production zone and a second toe section downhole of the second heel section and residing at a fourth production zone opposite the second production zone. The second heel section and the second toe section reside in their respective locations to help prevent, during production, pressure interference between the first production zone and the third production zone and to help prevent pressure interference between the second production zone and the fourth production zone.

In some implementations, drilling the first wellbore includes drilling the first wellbore through a first layer and a second layer of a multilayered reservoir. The first production zone is disposed at the first layer and the second production zone is disposed at the second layer. Drilling the second wellbore includes drilling the second wellbore through the first layer and the second layer. The third production zone is disposed at the first layer and the fourth production zone is disposed at the second layer. In some implementations, the method further includes, after drilling the second wellbore, completing the first wellbore and the second wellbore, and then extracting a first production fluid from the first layer through the first heel section. The method also includes extracting a second production fluid from the second layer through the first toe section, extracting a third production fluid from the first layer through the second heel section, and extracting a fourth production fluid from the second layer through the second toe section.

In some implementations, the first wellbore includes a first middle section disposed between the first heel section and the first toe section and the second wellbore includes a second middle section disposed between the second heel section and the second toe section. Drilling the second wellbore can include drilling the second wellbore such that the second middle section resides at a horizontal distance of between 0.1 and 0.8 kilometers from the first middle section.

In some implementations, drilling the second wellbore includes placing the second middle section at a similar vertical depth than the first middle section. In some implementations, drilling the first wellbore includes drilling the first wellbore through a third layer disposed between the first layer and the second layer and drilling the second wellbore includes drilling the second wellbore through the third layer. The first middle section and the second middle section each reside at the third layer of the multilayered reservoir. In some implementations, the method further includes, after drilling the second wellbore, completing the first wellbore and the second wellbore such that the first middle section and the second middle section are configured to flow production fluid from the third layer to a surface of the wellbore. In some implementations, the first middle section and the second middle section each include a flow control device configured to help prevent pressure interference between the first middle section and second middle section during production.

In some implementations, the first plane is spaced by a horizontal distance of between 0.1 and 0.8 kilometers from the second plane.

In some implementations, the first wellbore and the second wellbore have generally the same vertical depth such that the first heel section and the second heel section are disposed at a similar vertical distance from a surface of the wellbore. The first toe section and the second toe section are can be disposed at a similar vertical distance from the surface of the wellbore.

Implementations of the present disclosure include a production method. The method includes receiving, at a surface of a first, non-vertical wellbore and from the first wellbore, a first production fluid from a first heel section of the first wellbore and a second production fluid from a first toe section of the first wellbore. The first toe section is disposed downhole of the first heel section. The first wellbore defines a first central axis that defines a first plane. The method also includes receiving, at a surface of a second, non-vertical wellbore and from the second wellbore, a third production fluid from a second heel section of the second wellbore and a fourth production fluid from a second toe section of the second wellbore. The second toe section is disposed downhole of the first heel section. The second wellbore defines a second central axis defining a second plane substantially parallel to the first plane. The second wellbore extends in a direction opposite to the first wellbore such that the second heel section is opposite the first heel section and the second toe section is opposite the first toe section to help prevent, during the flowing of the respective production fluids, pressure interference between the first wellbore and the second wellbore.

In some implementations, the first wellbore extends through a first layer and a second layer of a multilayered reservoir and the second wellbore extends through the first layer and the second layer. The first heel section and the second heel section reside at the first layer and the first toe section and the second toe section reside at the second layer. In such implementations, receiving the respective production fluids includes receiving the respective production fluids flown from respective layers to the surface of the first and second wellbore. In some implementations, receiving the first production fluid includes receiving the first production fluid flown from the first layer, though the first heel section, to the surface of the first wellbore, and receiving the third production fluid includes receiving the third production fluid flown from the first layer, through the second heel section, to the surface of the second wellbore. In some implementations, receiving the second production fluid includes receiving the second production fluid flown from the second layer, though the first toe section, to the surface of the first wellbore. Receiving the fourth production fluid can include receiving the fourth production fluid flown from the second layer, through the second toe section, to the surface of the second wellbore.

Implementations of the present disclosure include a wellbore system that includes a first, non-vertical wellbore that includes a first heel section and a first toe section downhole of the heel section. The system also includes a second, non-vertical wellbore including a second heel section and a second toe section downhole of the second heel section. The second wellbore can extend in a direction opposite to the first wellbore, with the first heel section opposite the second heel section and the first toe section opposite the second toe section to help prevent, during production, pressure interference between the first wellbore and the second wellbore.

In some implementations, the first wellbore extends through a first layer and a second layer of a multilayered reservoir with the first heel residing at the first layer and the first toe residing at the second layer. The second wellbore can extend through the first layer and the second layer with the second heel section residing at the first layer and the second toe section residing at the second layer. The first wellbore and the second wellbore are configured to flow production fluid, from the first and second layers, to a respective surface of the first wellbore and the second wellbore. In some implementations, the first heel section is configured to receive a first production fluid from the first layer and flow the first production fluid to a surface of the first wellbore. The second heel section can be configured to receive a third production fluid from the first layer and flow the third production fluid to a surface of the second wellbore. The first toe section is configured to receive a second production fluid from the second layer and flow the second production fluid to a surface of the first wellbore. The second toe section can be configured to receive a fourth production fluid from the second layer and flow the fourth production fluid to a surface of the second wellbore.

In some implementations, the first wellbore extends through a third layer disposed between the first layer and the second layer. The second wellbore can extend through the third layer. The first wellbore can include a first middle section disposed between the first heel section and the first toe section and the second wellbore can include a second middle section disposed between the second heel section and the second toe section. Each of the first and second middle sections can reside at and flow to their respective surface a respective fifth and sixth production fluid form the third layer. In some implementations, the first middle section and the second middle section each include a flow control device configured to help prevent pressure interference between the first middle section and second middle section during production. In some implementations, the first heel section is spaced from the second heel section by a diagonal, horizontal distance of about 1.2 kilometers.

DETAILED DESCRIPTION OF THE DISCLOSURE

The present disclosure describes methods and systems for improving production or stimulation of two adjacent, non-vertical wellbores (for example, horizontal wellbores). The system includes two horizontal wellbores extending vertically parallel to each other in opposite directions. Each horizontal wellbore defines a heel section and a toe section. The heel section of the first wellbore is opposite the heel section of the second wellbore. Production and stimulation at the respective heel sections and toe sections is enhanced by avoiding pressure interference between the wellbores due to adequate spacing between the wellbore sections.

Particular implementations of the subject matter described in this specification can be implemented so as to realize one or more of the following advantages. For example, increasing the distance between two production zones of two horizontal wellbores allows two wellbores to be placed close to each other, increasing the rate of production. Placing two or more horizontal wellbores close to each other can increase the flexibility and cost-optimization of the drilling and production process.

Figure 1:
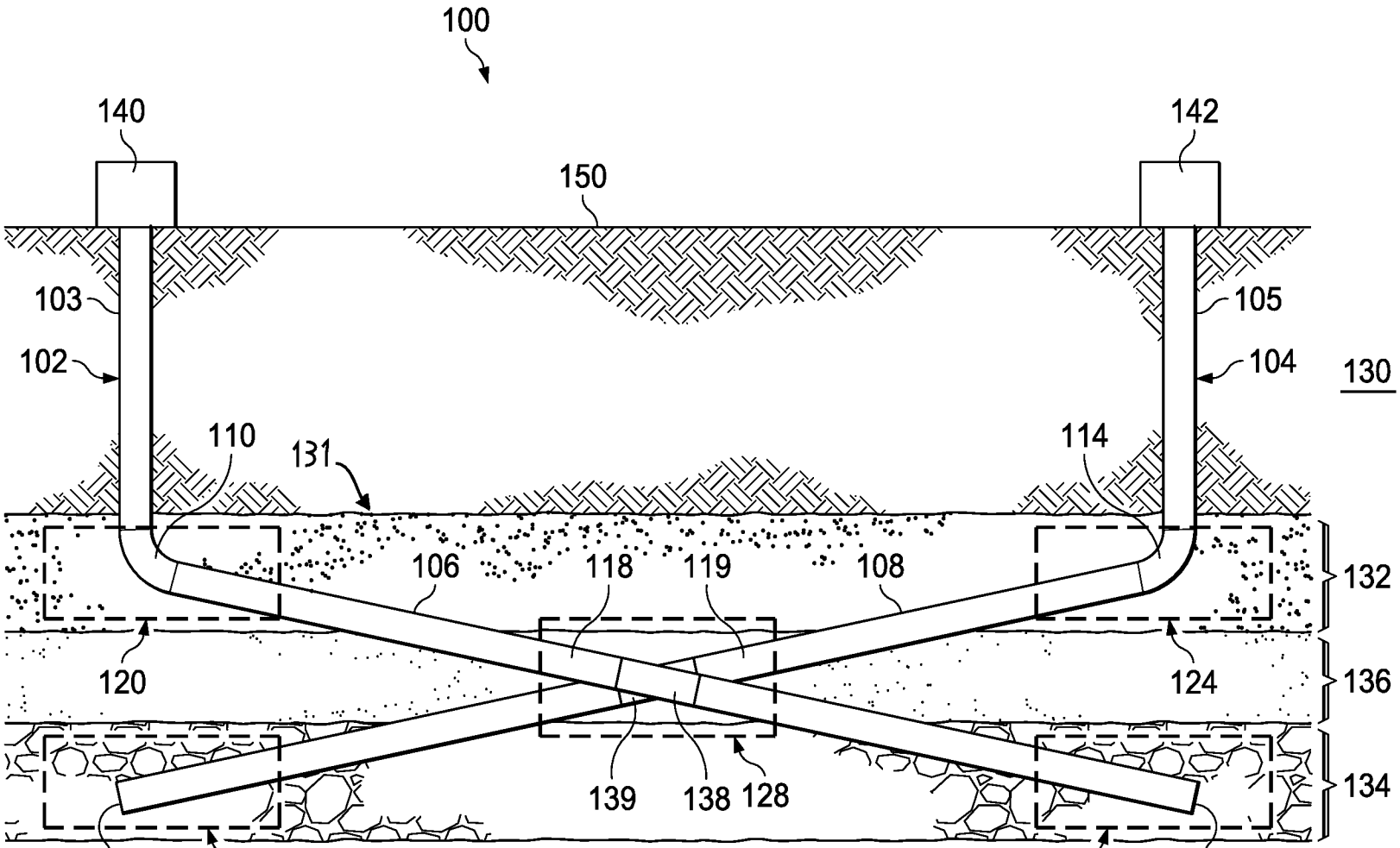
FIG. 1 is a side schematic view, partially cross sectional, of a wellbore system according to implementations of the present disclosure.

FIG. 1 shows a wellbore system 100 that includes a first wellbore 102 and a second wellbore 104 extending vertically parallel to the first wellbore 102. The first wellbore 102 and the second wellbore 104 are formed in a geologic or subterranean formation 130 that includes a multilayered hydrocarbon reservoir 131 (or multiple reservoirs) from which production fluid (for example, hydrocarbons) can be extracted. The first wellbore 102 extends from a first wellhead 142 at a surface 150 of the first wellbore 102 and the second wellbore 104 extends from a second wellhead 142 that is disposed at the same or different surface of the first wellbore 102. For example, the second wellbore 104 can extend vertically from the same surface 150 as the first wellbore 102, extending from a distant location with respect to the first wellbore 102.

The first wellbore 102 is a non-vertical wellbore that includes a vertical portion 103 and a non-vertical portion 106 (for example, a horizontal or generally horizontal wellbore portion). The non-vertical portion 106 can extend at an angle of between 60 and 90 degrees. In most cases, the angle can be between 85 and 89 degrees. The wellbore can extend at such angle while geosteering. Similarly, the second wellbore 104 is a non-vertical wellbore that includes a vertical portion 105 and a non-vertical portion 108 extending at a similar angle.

The non-vertical portion 106 of the first wellbore 102 extends, from the vertical portion 103, in a first direction through multiple layers of the multilayered reservoir 131. The non-vertical portion 108 of the second wellbore 104 extends, from the vertical portion 105, in a second direction opposite the first direction through the multiple layers to cross, in side view, the first wellbore 102. For example, the second wellbore 104 can be generally symmetric, about a vertical plane, with respect to the first wellbore 102 to form, with the first wellbore 102, in side view, an 'X' shaped two-wellbore configuration.

The first wellbore 102 extends through a first layer 132 and a second layer 134 of the multilayered reservoir 131. The multilayered reservoir 131 can also include a third layer 136 disposed between the first layer 132 and the second layer 134. The multilayered reservoir 131 can include more layers, for example, one or more layers (not shown) between the first layer 132 and the third layer 136 and one or more layers between the third layer 136 and the second layer 134. Each of the first, second, and third layers can include hydrocarbon reservoirs from which hydrocarbons can be extracted.

The first wellbore 102 includes a first heel or heel section 110 where the wellbore 102 transitions from vertical to non-vertical. The first wellbore 102 also includes a first toe or toe section 112 downhole of the heel section 110 at or near an end of the first wellbore 102. The first heel section 110 resides at a first production zone 120 of the first layer 132 and the first toe section 112 resides at a second production zone 122 of the second layer 134. Similar to the first wellbore 102, the second wellbore 104 has a second heel section 114 and a second toe section 116 downhole of the second heel section 114 at or near an end of the second wellbore 104. The second heel section 114 resides at a third production zone 124 of the first layer 132 and the second toe section 116 resides at a fourth production zone 126 of the second layer 134. As further described in detail later with respect to FIG. 3, the first heel section 110 is disposed opposite the second heel section 114 and the first toe section 112 is disposed opposite the second toe section 116 to help prevent, during production, pressure interference between the first wellbore 102 and the second wellbore 104.

Although FIG. 1 shows the wellbores drilled and completed through multiple layers, the wellbores can be drilled and completed through one layer of a hydrocarbon reservoir. For example, only the toe sections of each wellbore can be disposed at a reservoir layer to extract hydrocarbons. Additionally, although FIG. 1 shows all of the heel and toe sections disposed at respective production zones, only some of the heel and toe sections can be disposed at and configured to receive production fluid from production zones.

As shown in FIG. 1, each wellbore 102 and 104 can be configured to extract production fluid from three layers at three different production zones. The first production zone 120 and the third production zone 124 are disposed in the first layer 132. For example, the first heel section 110 of the first wellbore 102 and the second heel section 114 of the second wellbore 104 are each configured to receive production fluid trapped in the first layer 132. The first heel section 110 and the second heel section 114 can each include downhole equipment (not shown) such as an electric submersible pump to extract production fluid from the first layer 132. The first heel section 110 extracts production fluid from the first layer 132 at the first production zone 120 and the second heel section 114 also extracts production fluid from the first layer 132, at the third production zone 124. The first toe section 112 and the second toe section 116 also have downhole equipment to receive production fluid trapped in the third layer 134. The first toe section 112 extracts production fluid from the third layer 134 at the second production zone 122 and the second toe section 116 extracts production fluid from the third layer 134 at the fourth production zone 126. Thus, the production fluid flows, from each respective layer, through a respective toe or heel section, to the surface of each wellbore.

During production, the first wellbore 102 flows or extracts a first production fluid from the first layer 132 through the first heel section 110 to the surface 150. The second wellbore 104 flows or extracts a third production fluid from the first layer 132 though the second heel section 114 to the surface 150. The first production fluid is trapped in the first production zone 120 and the third production fluid is trapped in the third production zone 124. As further described in detail later with respect to FIG. 3, the first heel section 110 is disposed at a sufficient distance away from the second heel section 114 to help prevent pressure interference between the first production zone 120 and the third production zone 124.

The first wellbore 102 flows a second production fluid from the second layer 134 through the first toe section 112 to the surface 150. The second wellbore 104 flows a fourth production fluid from the third layer 134 though the second toe section 116 to the surface 150. The second production fluid is trapped in the second production zone 122 and the fourth production fluid is trapped in the fourth production zone 126. As further described in detail later with respect to FIG. 3, the first toe section 112 is disposed at a sufficient distance away from the second toe section 116 to help prevent pressure interference between the second production zone 122 and the fourth production zone 126.

The first wellbore 102 can have a first middle section 118 disposed between the first heel section 110 and the first toe section 112. Similar to the first heel section 110 and the first toe section 112, the first middle section 118 can have downhole equipment (not shown) to receive production fluid from the third layer 136 at a fifth production zone 128. Thus, the first wellhead 140 can receive production fluid from the first, second, and third layer extracted by the first heel section 110, the first toe section 112, and the first middle section 118, respectively. Similarly, the second wellbore 104 can have a second middle section 119 disposed between the second heel section 114 and the second toe section 116. The second middle section 119 can be disposed at a similar vertical depth than the first middle section 118. The second middle section 119 can also receive production fluid from the third layer 136 at the fifth production zone 128 or at a sixth production zone 129, separate from the fifth production zone 128. Thus, a fifth production fluid trapped in the fifth production zone 128 flows through the first middle section 118 to the surface 150 and a sixth production fluid trapped in the fifth or sixth production zone 129 flows through the second middle section 119 to the surface 150 of the wellbores.

Because the first middle section 118 and the second middle section 119 are both disposed in relatively closed proximity to each other, each middle section can have equipment to help prevent pressure interference between the first wellbore 102 and the second wellbore 104 during production. For example, the first wellbore 102 can have a first flow control device 138 at the first middle section 118 and the second wellbore 104 can have a second flow control device 139 at the second middle section 119. Each flow control device 138 and 139 helps prevent pressure interference between the first middle section 118 and second middle section 119 during production. For example, each flow control device can be an inflow control device or an inflow control valve(s) that helps regulate the flow and pressure from the reservoir to the wellbore. Each flow control device can also help balance the pressure distribution from heel to toe.

Figure 2:
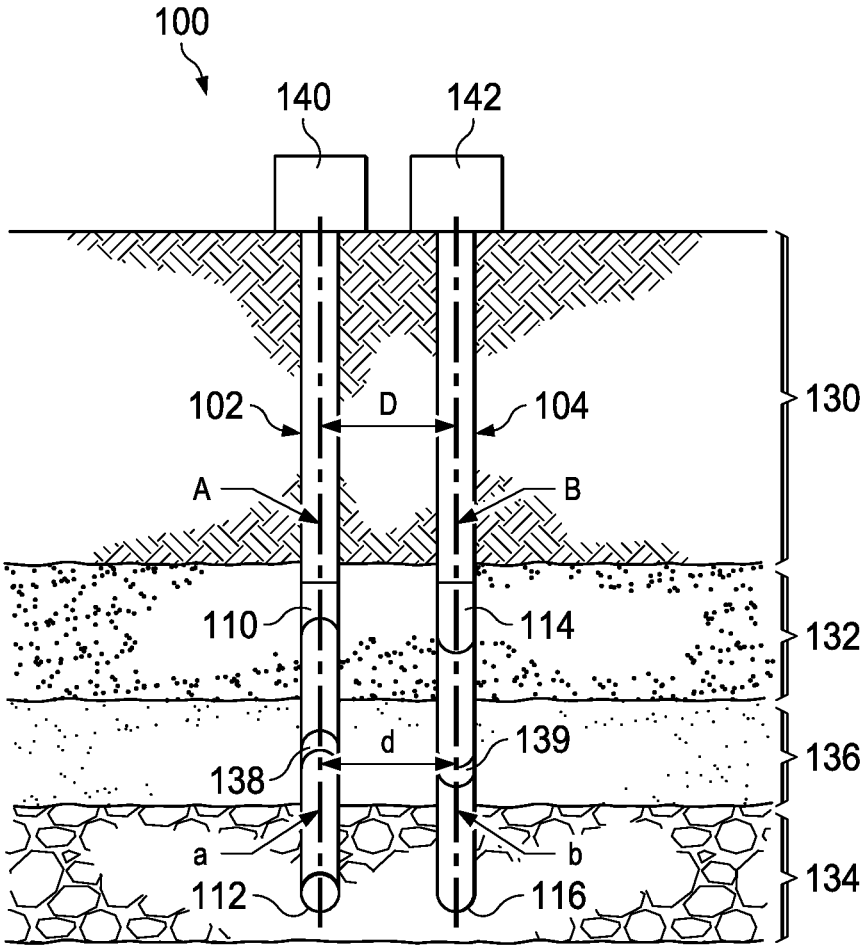
FIG. 2 is a front schematic view, partially cross sectional, of the wellbore system of FIG. 1.

FIG. 2 shows a front schematic view of the wellbore system 100. The first wellbore 102 and the second wellbore 104 have generally the same vertical depth. For example, the first heel section 110 and the second heel section 114 are disposed generally on the same horizontal plane or at a similar vertical distance from the surface 150 of the wellbores. Similarly, the first toe section 112 and the second toe section 116 are disposed at a similar vertical distance from the surface 150 of the wellbores.

As shown in FIG. 2, the first wellbore 102 and the second wellbore 104 extend, in front view, generally parallel to each other. For example, the first wellbore 102 defines a central axis 'a' that includes a first generally vertical plane 'A' and the second wellbore 104 includes a central axis 'b' that includes a second generally vertical plane 'B'. The first generally vertical plane 'A' is disposed at a horizontal distance 'D' of about between 0.1 and 0.8 kilometers (for example, 0.5 kilometers) from the generally vertical plane 'B' that extends across the second wellbore 104. Thus, the first flow control device 138 (or the first middle section) of the first wellbore 102 resides at a horizontal distance 'd' of about 0.5 kilometers from the second flow control device 139 (or the second middle section of the second wellbore 104). Thus, when the first wellbore 102 and the second wellbore 104 extend generally parallel to each other, distance 'D' is generally the same as distance 'd'. In some implementations, the first wellbore 102 and the second wellbore 104 do not extend parallel to each other. For example, the non-vertical portion of the first wellbore 102 (or the second wellbore 104) can deviate from the vertical plane 'A' away from or toward the second wellbore 104.

Figure 3:
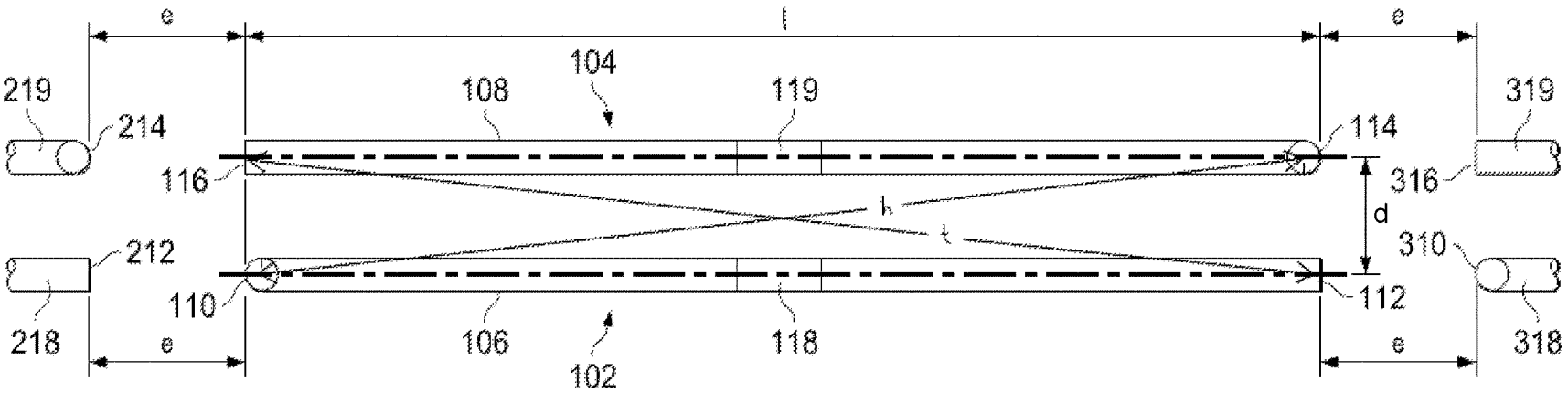
FIG. 3 is a top schematic view, partially cross sectional, of a portion of the wellbore system of FIG. 1.

FIG. 3 shows a top schematic view of the non-vertical portion 106 of the first wellbore 102 and the non-vertical portion 108 of the second wellbore 104. The first heel section 110 of the first wellbore 102 is spaced or separated by a horizontal, diagonal distance 'h' from the second heel section 114 of the second wellbore. The first toe section 112 and the second toe section 116 are spaced by a distance T. As described earlier with respect to FIG. 1, the first heel section 110 and the second heel section 114 can reside on the same horizontal plane, and the first toe section 112 and the second toe section 116 can reside on a same horizontal plane disposed under the horizontal plane of the heel section. Thus, distance 'h' can be similar or equal to a distance between the first wellhead (see FIG. 1) and the second wellhead. Distance 'h' can be, for example, 1.2 kilometers, sufficient to prevent or reduce pressure interference between the respective production zones. Distance 't' is a function of distance 'd' and of the length '1' of the non-vertical portions of the wellbores. Thus, distance 't' can be similar to distance 'h' or, depending on the length '1' of the non-vertical wellbore portions, larger or smaller.

Additional wellbores or pairs of wellbores similar to the first wellbore 102 and the second wellbore 104 can be placed near the first wellbore 102 and the second wellbore 104. For example, a third wellbore 218 and a fourth wellbore 219 can be drilled next to the first wellbore 102 and the second wellbore 104 in a similar configuration to the first wellbore 102 and the second wellbore 104. A toe section 212 of the third wellbore 218 can be separated from the first heel section 110 of the first wellbore 102 by a horizontal distance e' of about 0.5 kilometers. The toe section 212 of the third wellbore 218 can be disposed at the same layer or horizontal plane as the first toe section 112 of the first wellbore 102. Similarly, a heel section 214 of the fourth wellbore 219 can be disposed at a horizontal distance 'e' from the toe section 116 of the second wellbore 104. A third pair of wellbores can be placed at an opposite end of the first wellbore 102 and the second wellbore 104. For example, a fifth wellbore 318 and a sixth wellbore 319 can be drilled such that a heel section 310 of the fifth wellbore 318 is disposed at a horizontal distance e' from the toe section 112 of the first wellbore, and a toe section 316 of the sixth wellbore 319 is disposed at a horizontal distance e' from the heel section 114 of the second wellbore.

Figure 4:
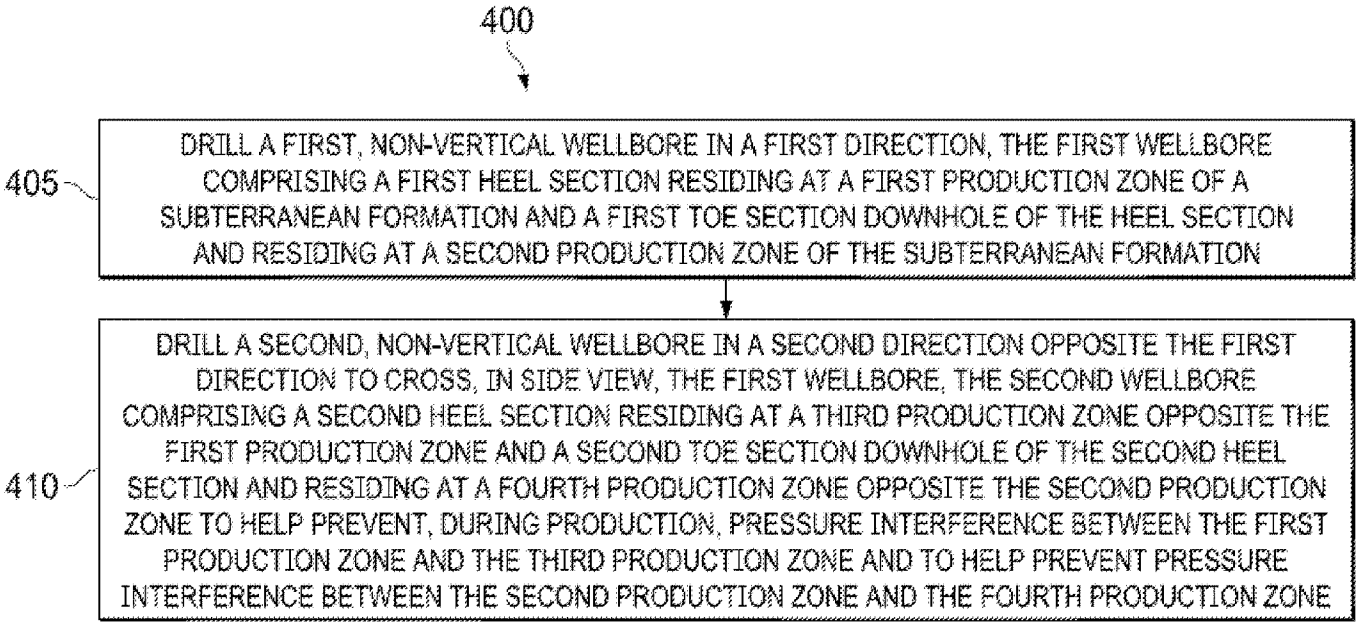
FIG. 4 is a flow chart of an example method of drilling two wellbores in a multilayered reservoir.

FIG. 4 shows a flow chart of a method 400 of drilling or placing two wellbores (for example, the first wellbore 102 and second wellbore 104 of FIGS. 1-3). The method includes drilling a first, non-vertical wellbore in a first direction. The first wellbore comprises a first heel section residing at a first production zone of a subterranean formation and a first toe section downhole of the heel section and resides at a second production zone of the subterranean formation (405). The method also includes drilling a second, non-vertical wellbore in a second direction opposite the first direction to cross, in side view, the first wellbore. The second wellbore comprises a second heel section residing at a third production zone opposite the first production zone and a second toe section downhole of the second heel section and residing at a fourth production zone opposite the second production zone to help prevent, during production, pressure interference between the first production zone and the third production zone and to help prevent pressure interference between the second production zone and the fourth production zone (410).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A method comprising:

drilling a first, non-vertical wellbore in a first direction, the first wellbore comprising a first heel section residing at a first production zone of a subterranean formation and a first toe section downhole of the first heel section and residing at a second production zone of the subterranean formation; and drilling a second, non-vertical wellbore in a second direction opposite the first direction such that in side view, the second wellbore crosses the first wellbore, the second wellbore comprising a second heel section residing at a third production zone in fluid communication with the first production zone, the second heel section opposing, in side view, the first heel section, the second wellbore further comprising a second toe section downhole of the second heel section, the second toe section opposing, in side view, the first toe section and residing at a fourth production zone in fluid communication with the second production zone to prevent or reduce, during production, pressure interference between the first production zone and the third production zone and to prevent or reduce pressure interference between the second production zone and the fourth production zone.

2. The method of claim 1, wherein drilling the first wellbore comprises drilling the first wellbore through a first layer and a second layer of a multilayered reservoir, the first production zone disposed at the first layer and the second production zone disposed at the second layer, and wherein drilling the second wellbore comprises drilling the second wellbore through the first layer and the second layer, the third production zone disposed at the first layer and the fourth production zone disposed at the second layer.

3. The method of claim 2, further comprising, after drilling the second wellbore:

completing the first wellbore and the second wellbore; and extracting a first production fluid from the first layer through the first heel section, extracting a second production fluid from the second layer through the first toe section, extracting a third production fluid from the first layer through the second heel section, and extracting a fourth production fluid from the second layer through the second toe section.

4. The method of claim 2, wherein the first wellbore comprises a first middle section disposed between the first heel section and the first toe section and wherein the second wellbore comprises a second middle section disposed between the second heel section and the second toe section such that in side view, the second middle section crosses the first middle section, and wherein drilling the second wellbore comprises drilling the second wellbore such that, in front view, the second middle section resides at a horizontal distance of between 0.1 and 0.8 kilometers from the first middle section, the horizontal distance extending in a direction perpendicular with respect to a length of the first non-vertical wellbore.

5. The method of claim 4, wherein drilling the second wellbore comprises placing the second middle section at a similar vertical depth as the first middle section.

6. The method of claim 4, wherein drilling the first wellbore comprises drilling the first wellbore through a third layer disposed between the first layer and the second layer and wherein drilling the second wellbore comprises drilling the second wellbore through the third layer, wherein the first middle section and the second middle section each reside at the third layer of the multilayered reservoir.

7. The method of claim 6, further comprising, after drilling the second wellbore, completing the first wellbore and the second wellbore such that the first middle section and the second middle section are configured to flow production fluid from the third layer to a surface of the wellbore.

8. The method of claim 6, wherein the first middle section and the second middle section each comprise a flow control device configured to prevent or reduce pressure interference between the first middle section and second middle section during production.

9. The method of claim 1, wherein the first heel is spaced, in front view, by a first horizontal distance of between 0.1 and 0.8 kilometers from the second heel, the first horizontal distance extending in a direction perpendicular with respect to a length of the first non-vertical wellbore, and the first toe is spaced, in front view, by a second horizontal distance of between 0.1 and 0.8 kilometers from the second toe, the first horizontal distance extending in a direction perpendicular with respect to a length of the first non-vertical wellbore.

10. The method of claim 1, wherein the first wellbore and the second wellbore have generally the same vertical depth such that the first heel section and the second heel section are disposed at a similar vertical distance from a surface of the wellbore, and wherein the first toe section and the second toe section are disposed at a similar vertical distance from the surface of the wellbore.

11. A method comprising:

receiving, at a surface of a first, non-vertical wellbore and from the first wellbore, a first production fluid from a first heel section of the first wellbore and a second production fluid from a first toe section of the first wellbore, the first toe section downhole of the first heel section; and receiving, at a surface of a second, non-vertical wellbore and from the second wellbore, a third production fluid from a second heel section of the second wellbore and a fourth production fluid from a second toe section of the second wellbore, the second toe section downhole of the second heel section, the second wellbore extending in a direction opposite to the first wellbore such that, in side view, the second wellbore crosses the first wellbore, the second heel section opposing, in side view, the first heel section and the second toe section opposing, in side view, the first toe section to reduce or prevent, during the flowing of the respective production fluids, pressure interference between the first wellbore and the second wellbore.

12. The method of claim 11, wherein the first wellbore extends through a first layer and a second layer of a multilayered reservoir and the second wellbore extends through the first layer and the second layer, the first heel section and the second heel section residing at the first layer and the first toe section and the second toe section residing at the second layer, and wherein receiving the respective production fluids comprises receiving the respective production fluids flown from respective layers to the surface of the first and second wellbore.

13. The method of claim 12, wherein receiving the first production fluid comprises receiving the first production fluid flown from the first layer, though the first heel section, to the surface of the first wellbore and wherein receiving the third production fluid comprises receiving the third production fluid flown from the first layer, through the second heel section, to the surface of the second wellbore.

14. The method of claim 12, wherein receiving the second production fluid comprises receiving the second production fluid flown from the second layer, though the first toe section, to the surface of the first wellbore and wherein receiving the fourth production fluid comprises receiving the fourth production fluid flown from the second layer, through the second toe section, to the surface of the second wellbore.

15. A wellbore system comprising:

a first, non-vertical wellbore comprising a first heel section and a first toe section downhole of the heel section; and a second, non-vertical wellbore comprising a second heel section and a second toe section downhole of the second heel section, the second wellbore extending in a direction opposite to the first wellbore such that, in side view, the second wellbore crosses the first wellbore, with the first heel section opposing, in side view, the second heel section and the first toe section opposite, in side view, the second toe section to reduce or prevent, during production, pressure interference between the first wellbore and the second wellbore.

16. The wellbore system claim 15, wherein the first wellbore extends through a first layer and a second layer of a multilayered reservoir with the first heel residing at the first layer and the first toe residing at the second layer, and wherein the second wellbore extends through the first layer and the second layer with the second heel section residing at the first layer and the second toe section residing at the second layer, and wherein the first wellbore and the second wellbore are configured to flow production fluid, from the first and second layers, to a respective surface of the first wellbore and the second wellbore.

17. The wellbore system claim 16, wherein the first heel section is configured to receive a first production fluid from the first layer and flow the first production fluid to a surface of the first wellbore and wherein the second heel section is configured to receive a third production fluid from the first layer and flow the third production fluid to a surface of the second wellbore, wherein the first toe section is configured to receive a second production fluid from the second layer and flow the second production fluid to a surface of the first wellbore and wherein the second toe section is configured to receive a fourth production fluid from the second layer and flow the fourth production fluid to a surface of the second wellbore.

18. The wellbore system claim 16, wherein the first wellbore extends through a third layer disposed between the first layer and the second layer and wherein the second wellbore extends through the third layer, the first wellbore comprising a first middle section disposed between the first heel section and the first toe section and the second wellbore comprising a second middle section disposed between the second heel section and the second toe section such that, in side view, the second middle section crosses the first middle section, each of the first and second middle sections residing at and configured to flow to their respective surface a respective fifth and sixth production fluid form the third layer.

19. The wellbore system claim 18, wherein the first middle section and the second middle section each comprise a flow control device configured to prevent or reduce pressure interference between the first middle section and second middle section during production.

20. The wellbore system claim 15, wherein the first heel section is spaced from the second heel section by a horizontal distance of about 1.2 kilometers, the horizontal distance extending in a direction perpendicular with respect to a length of the first non-vertical wellbore.

* * * * *